United States Patent [19]

Tsukamoto

[11] Patent Number: 4,523,354

[45] Date of Patent: Jun. 18, 1985

[54] CLIP FOR SHEET MATERIAL

[76] Inventor: Tatuzo Tsukamoto, 2570, Ohaza Mukaizima, Chiyodamachi, Kanzakigun, Saga 842, Japan

[21] Appl. No.: 486,287

[22] PCT Filed: Jun. 28, 1982

[86] PCT No.: PCT/JP82/00249

§ 371 Date: Feb. 28, 1983

§ 102(e) Date: Feb. 28, 1983

[87] PCT Pub. No.: WO83/00119

PCT Pub. Date: Jan. 20, 1983

[30] Foreign Application Priority Data

Jul. 1, 1981 [JP] Japan ..... 56-103674
Mar. 25, 1982 [JP] Japan ..... 57-48233

[51] Int. Cl.[3] ..... B42F 1/02; A44B 21/00

[52] U.S. Cl. ..... 24/67.9; 24/67 R; 24/67.3; 24/546

[58] Field of Search ..... 24/67.9, 67.3, 67 R, 24/67.1, 67.5, 67.7, 67.11, 153, 545, 546; D19/65

[56] References Cited

U.S. PATENT DOCUMENTS

| | | | |
|---|---|---|---|
| D. 50,283 | 2/1917 | Peet | D19/65 |
| 560,025 | 5/1896 | Ellis | 24/67.9 |
| 666,972 | 1/1901 | O'Neal | 24/67.9 |
| 860,426 | 7/1907 | Ware | 24/153 |
| 1,916,639 | 7/1933 | Rogers | 24/546 |
| 2,435,174 | 1/1948 | Bell | 24/546 |
| 2,599,146 | 6/1952 | Wagner et al. | 24/67.3 |
| 2,838,817 | 6/1958 | Wills | 24/67.9 |
| 3,105,278 | 10/1963 | Sponsel | 24/67.9 |
| 4,237,587 | 12/1980 | Hsiao et al. | 24/67 R |

FOREIGN PATENT DOCUMENTS

| | | | |
|---|---|---|---|
| 317844 | 9/1902 | France | 24/69.7 |
| 366551 | 7/1929 | Japan . | |
| 35853 | 10/1972 | Japan . | |
| 709353 | 5/1954 | United Kingdom | 24/67.9 |

OTHER PUBLICATIONS

Bainbridge, Kimpton & Haupt, Inc., One Sheet, Page No. 126, Date Apr. 14, 1953, Universal FIG. 24/67.9.

*Primary Examiner*—Victor N. Sakran
*Attorney, Agent, or Firm*—Jordan and Hamburg

[57] ABSTRACT

A clip which can rapidly grip sheets such as clerical documents and which can also release them separately as required, includes a back unit bent to an approximately U-shaped form having two shafts extending symmetrically, a back unit formed of two crossing arms bent to laterally pass each other from the rear ends of the two shafts of the back unit and two pressing units bent forward and inside to approach the outer sides of the two shafts of the back unit at the outer ends of the crossing arms, thereby pressing the clerical sheets between the back unit and the pressing units.

18 Claims, 10 Drawing Figures

CLIP FOR SHEET MATERIAL

FIELD OF THE INVENTION

The present invention relates to a clip which can rapidly grip sheets such as loose documents and which can also release them separately as required.

BACKGROUND OF THE INVENTION

In a conventional clip, that is a clip with the trademark name "GEM", a wire is rolled into rectangular form in one plane and is formed with two arms to the inner and outer sides. Such a clip has many disadvantages in that it does not tightly grip thick sheets without sliding. That is to say, at the time that thick sheets are gripped between the two arms, the long arm opens and the edge side of the sheets slip from the side face. Also, the gripping power concentrates at the edge sides of the sheets. For these reasons, the part which opens up in use is easily caught in other objects, and the clip comes off easily some times and it is inconvenient for stacking purposes. The stress concentrates at the small back part which is located at the base of the two arms, and therefore the stress of such part exceeds the elastic limit of the wire and does not return to its initial condition. Also, at the time of turning of gripped pages, it is impossible to turn up pages enough because the edge of the crossing arms disturbs the turn-up pages. The clip is pushed out from the sheets when the gripped sheets open a little strongly. Thus, such a GEM clip is not suitable for thick sheets.

At the present time, as a clip unit for thick sheets, a double clip is known which has a gripper with an isosceles triangle and a horizontal section is formed having a constant breadth. Such a double clip is used for sheets which have less height than the back part of the double clip because the thickness for gripping is limited according to the height of the back part which corresponds to the base of the isosceles triangle of the gripper. Therefore, in most cases, the high back part of the gripper sticks out from the edge of the gripped sheets at a right angle toward the gripped face. This stuck-out part is inconvenient at the time that the gripped sheets are piled up. A lever also interferes with the turn-up of pages. Such double clip further has a defect in that it is expensive to produce as compared to other kinds of clips.

A clip providing crossing arms which cross at the back part of the gripped part is disclosed in Japanese Utility Model No. 366551 and an all-round clip is disclosed in Japanese Utility Model No. Showa 47-35853. These clips provide for capacity in that the gripper tightly grips both faces of the gripped sheets even at the time of gripping thick sheets. However, in the former, the direction of the touching line is such that the part which has the main gripping effect faces closely at a right angle toward the edge of the gripped sheets and is very long. Also, in the latter, one side of the gripped part has a wide face. Consequently, a long touching line of the gripped part has a direction which slips easily on the part which is formed by the touching face is hardly wide enough for good gripping. Therefore, there is a defect in that the gripped sheets easily slip off, or the clip slides out easily from the gripped sheets when in use. Also, there are problems in the efficiency, the cost and the handling because these clips need to be united from a plurality of parts.

SUMMARY OF THE INVENTION

Taking into consideration the above-mentioned disadvantages of conventional clips, a clip which responds to present needs has to satisfy the following. First of all, the projecting part of the face and back sides of the clip should be small in spite of the thickness of the sheets, and the sheets should be gripped evenly. The gripped part would have enough gripping power, and the clip itself or the gripped sheets should not slide or come off. The handling of the gripping or removing should be easy, and the gripped surface should not be injured. The gripped sheets should be able to be opened or turned while keeping the grip. It should also be possible to produce a clip inexpensively.

The clip of the present invention is constructed with a back retainer, a back unit and pressing units. The back retainer is formed such that the top and part of the clip unit are combined with a connected part, and its back end part has two shafts extending symmetrically backwardly at a constant space therebetween.

The back unit is formed such that the back and the parts of the two shafts mutually face each other, and its outer side part passes through at least the back end part of the other shafts with two crossing arms.

The pressing units are formed as two units of which the edge parts are bent to the head part and the inner part from the outer edge parts of the crossing arms. Both edges of such pressing units approach the part which comes into the head part from the rear edge part of the shafts of each other sides at a constant distance.

The part which comes into the head from the edges of the gripped sheets are at a constant distance between the pressing units and a back retainer. Also, the present clip has a shaft which has simple torsion elasticity and long crossing arms. Short pressing units are bent to the head while protruding outwardly. At the time of gripping, the shafts are simply distorted. Therefore, there is not a large size curve or torsion at the pressing units and the crossing arms at the time of gripping thick sheets. Leaping up or sticking out of both sides of the gripped sheets also does not occur. Enough gripping space is provided between the edges of the pressing units and the back retainer because the edges of the pressing units are separated enough from each shaft which are the center of rotation and have a large rotation radius. Even at the time of gripping thick sheets, excessive action is not imposed on the shafts, and the shafts are hardly deformed. The edges of the pressing units are bent at the most inner side, the pressing units projecting and strongly pressing against the surface of the gripped sheets at the time that the crossing arms slope relative to the gripped sheets. The edges of the pressing units are tightly engaged at the surface of the gripped sheets and hardly slip and the sheets are tightly gripped.

The present invention provides a clip which grips tightly along both side faces and edges of the gripped sheets in spite of the thickness of the sheets. Also it is possible to open or turn pages of the gripped sheets.

DESCRIPTION OF THE PREFERRED EMBODIMENTS

Figure 1:
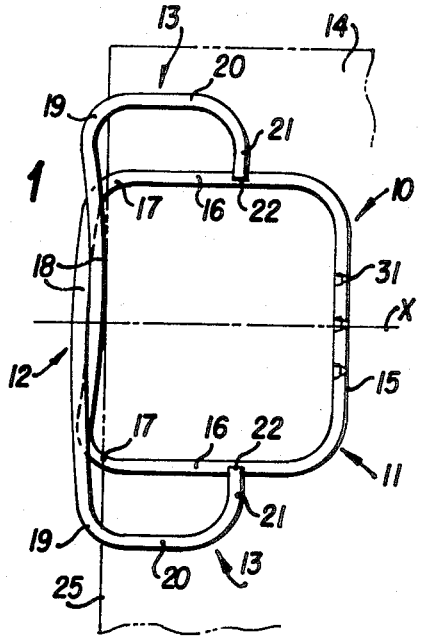
FIG. 1 is a plan view of a clip according to one embodiment of the present invention and shows the condition where sheets are gripped by the clip.
Figure 2:
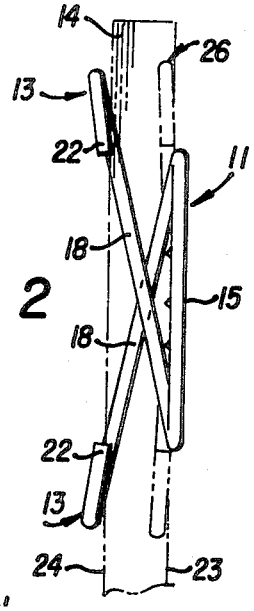
FIG. 2 is an elevational view of the clip shown in FIG. 1.
Figure 3:
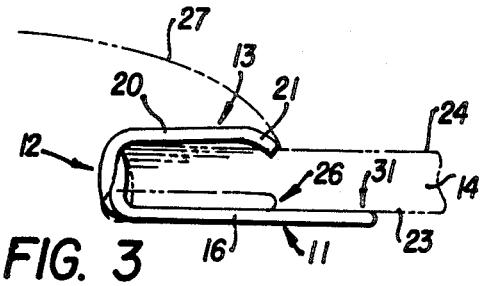
FIG. 3 is a partial transverse sectional view of the clip shown in FIG. 1.

Clip 10 shown in FIGS. 1 to 3 is produced from a single round wire which is bent. The clip 10 has a symmetrical axis X and has a substantially symmetrical form. The clip 10 is composed of three main parts including a back retainer 11, a back unit 12 and two pressing units 13. FIGS. 1 to 3 show the condition of the clip 10 as it grips sheets 14. The back retainer has the form of a U-shaped hollow part 15 having a constant length and which extends at a right angle relative to the symmetrical axis X along with straight shafts 16 having equal lengths which extend at a right angle relative to the connected part 15. Rear edge parts 17 are provided which form a right angle and connect two crossing arms 18 having the same constant length. The crossing arms 18 have outer edge parts 19 passing beyond rear edge parts 17. Both crossing arms 18 are curved a little to avoid interferring at an intermediate part where they cross. These two crossing arms 18 form the back retainer 12 of the clip. Outer parts 19 of the crossing arms 18 are further bent at almost a right angle and the pressing parts 13 extend therefrom. The pressing units 13 have a front-curved part 20 and an inner-curved part 21 which is bent inwardly toward the symmetrical axis X. Thus, the inner ends 22 of the bent pressing units 13, that is the edge of the pressing units 13 are positioned to approach shafts 16 under the condition of its relaxed state as shown in broken lines 26 in FIG. 2. The pressing units 13 extend widely beyond the outer side of the shafts 16, and such arrangement fulfills the finger positional function when both pressing units 13 are opened toward one side of the back retainer 11 at the time the sheets are gripped. The clip 10 is shown in FIGS. 1 to 3 with sheets 14 gripped therein.

In using the clip, first the thumb engages the face side of the clip at which both crossing arms 18 are crossed, and the forefinger, along with the middle finger, engage the rear of the back sides of both pressing units 13 and then hold the clip. Secondly, the back retainer 11 receives the back side 23 of the sheets 14, both pressing units 13 being pushed up to the upper side of the face 24 of the sheet by the finger tips, while maintaining the balance of the clip. Then the pressing units 13 that were pushed up receive the sheets as they are slipped to the head as they are inserted.

In the gripping condition which is shown in FIGS. 1 to 3, both crossing arms 18 form the back unit 12 which crosses at the rear part of the edge 25 of the sheets. Crossing arms 18 turn a little from the free-condition position shown by broken lines 26 in FIG. 2. Both pressing units 13 slope with turning of the crossing arms 18, and sharp-pointed end 22 of the pressing units project toward the inner part and tightly press the surface of the sheet 24 of the gripped sheets. The back side face 23 of the sheet is pressed by the pressing units and the gripped sheets 14 are gripped on both side faces and are vertically pressed. The inner curved part 21 which extends from the rear edge of the front-curved part 20 is disposed a little from the surface of the face side 24 of the sheet or lightly touches. Thus, the sheets are gripped at a position spaced from the edge 25 of the sheets so that the power of the clip 10 is not applied at the rear edge 25 of the sheet. Also, the edges 22 of the pressing units 13 make a depression in the surface of the sheet 24 and prevent the sheets from sliding and moving. The extent of the projection and the pressure of the edge 22 toward the lower part are excellent and in direct proportion to the depth of the sheets so the clip has a desirable condition corresponding to the thickness of the sheets. The top and bottom movement of both pressing units 13 in the clip is mainly brought about by torsion of shafts 16, the edges 22 having a long rotation radius and the large shafts 16 providing excellent flexibility with good gripping and the ability to open wide. Thus, the main part of elastic deformation for obtaining the gripping effect is provided by simple torsion shafts 16. Therefore, the back retainer 11 is disposed against the back side of the sheet 23 without raising from the surface. Also, a smooth, nice touching gripping action is obtained in the over-all sides of the pressing units 13 with the wire edges 22. The end edges 22 of pressing units 13 press the surface of the sheets 24 and the clip does not deeply press the edge part 25 as do conventional GEM clips. Therefore, it is possible to lift or open pages of the sheets as indicated at 27 in FIG. 3. At the time of removing the clip 10, first the inside of a nail of the forefinger and/or the middle finger is placed to the depth of the lower side where both crossing arms 18 cross, and at the same time, the thumb is placed to the rear side part of the surface of sheet 24. Both crossing arms 18 are lifted to the rear side by the forefinger while pressing the surface of sheet 24 with the thumb.

By proceeding as above, it is possible to remove the clip from sheets without injuring the surface of the gripped sheets 14.

Figure 4:
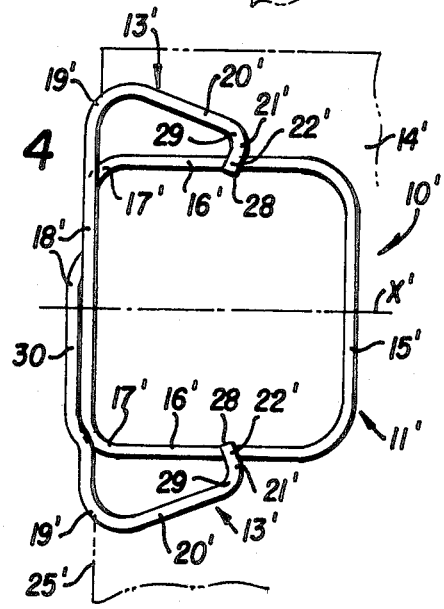
FIG. 4 is a plan view of a clip according to another embodiment and shows the condition where sheets are gripped by the clip.
Figure 5:
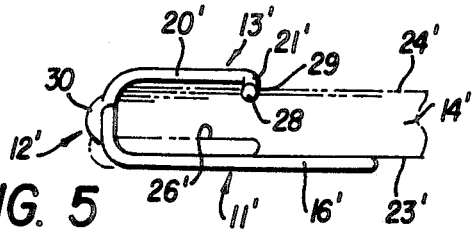
FIG. 5 is a transverse sectional view of the clip shown in FIG. 4.

Another clip form of the present invention is shown in FIGS. 4 and 5. In the explanation of subsequent clip forms, each part which corresponds to the parts as shown in the embodiment of FIGS. 1 to 3 will have the same reference number but with subscripts.

In FIGS. 4 and 5, both pressing units $13^1$ of clip $10^1$ have a front-curved part $20^1$ which extends to the head while sloping at a constant angle relative to the outer ends $19^1$ of both crossing arms $18^1$. Furthermore, the end of the front-curved part $20^1$ is bent to extend to the inner side at an angle which is close to a right angle and forms a short inner-curved part $21^1$. The end of inner-curved part $21^1$ faces a little to the rear and approaches closely to the outer side of shafts $16^1$ in the unflexed, free condition as in the previous embodiment of FIGS. 1 to 3. With regard to the embodiment of FIGS. 1 to 3, the head side of the front-curved part 20 raises a little relative to the surface of the sheet 24. In the embodiment of FIGS. 4 and 5, the slope which is formed is of a moderate descent along the front-curved part $20^1$ at the time that the pressing units $13^1$ are open. Therefore, when the sheets $14^1$ are gripped, the whole of the front-curved part $20^1$ runs along the surface of sheet $24^1$ more closely on an average. It is strongly desired that the edge part of the processing units be positioned as low as possible without coming up to the surface. The end of the inner-curved part $21^1$ is bent a little toward the rear side, as indicated at $22^1$, so that the edge face $28^1$ controls the slip on the surface of sheet $24^1$ at the time that the parts $22^1$ slip on the surface of sheet $24^1$. The slope toward the rear part of the inner-curved part $21^1$ has a desirable function at the time of removing the clip. Namely, at the time that the crossed parts of the crossing arms $18^1$ are lifted, the part which passes on the surface of the sheet $24^1$ moves to the side of the angle part 29 which leads from edge parts 22; and the pressure on the side of the edge face $28^1$ is loosened. From these actions, smooth removal of the slip is assured without injuring the surface of the sheets. Clip $10^1$ has a different arrangement wherein both crossing arms $18^1$ cross smoothly. That is to say, distortion of both pressing units that is caused by crossing and touching of both crossing arms is avoided by the base-losing part 30. Both crossing arms $18^1$ engage the edge $25^1$ of the sheets and balance is obtained. Usually in a clip having both crossing arms which cross, a little imbalance occurs which faces the front and back of the crossing arms as the crossed part comes out at the side of the outer edge. Therefore, the side of the outer edge of one of the crossing arms sticks out on the back side from the edge of the gripped sheets, and the sheets are gripped under an irregular gripping condition. Also, the touching of the crossed part of both crossing arms effects the opening condition of the gripped part and results in imbalance of both pressing units on the surface of the gripped sheets.

In the above-described clip 10 and clip $10^1$, it is possible to obtain balance of the crossing arms only at the time that the gripped sheets are gripped at the side of the back retainer. It is impossible to use a clip which is turned out, that is, to use a clip which is held at one side of a back retainer because the curved and the crossed sides of the crossing arms are completely reversed. A clip unit is usually used readily in the process of business working, and quick handling is required. Therefore, at the time of using the clip, the limitation of the front and back of a clip causes inconvenience, and it is important to be able to to use a clip invariably at both sides. Furthermore, generally in this kind of clip, a little deformation is unavoidable at the time that thick sheets are gripped. A deformed clip which is turned out such as a conventional GEM clip results in having to correct the deformation. It is desirable to be able to use a clip under good conditions at either side. FIGS. 6 to 10 show desirable forms which correspond to the above.

Figure 8:
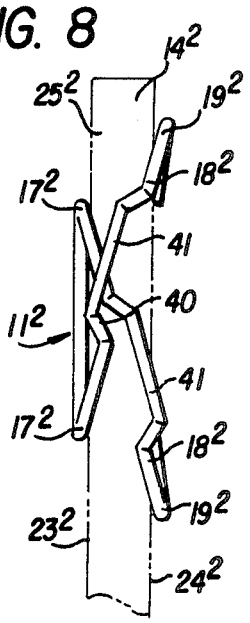
FIG. 8 is a rear elevational view of the clip shown in FIG. 6.
Figure 6:
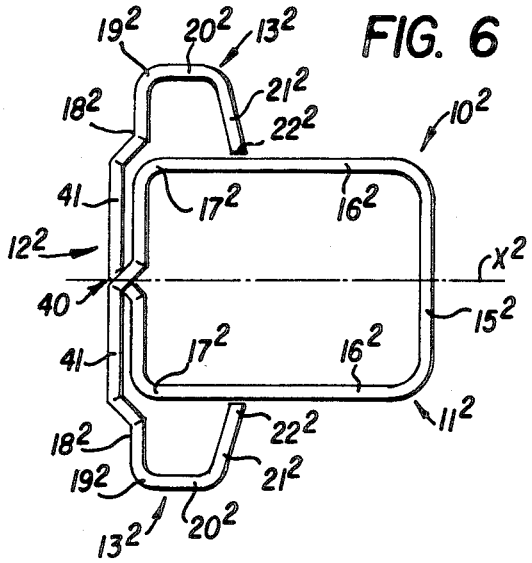
FIG. 6 is a plan view of a clip according to a further embodiment.
Figure 7:
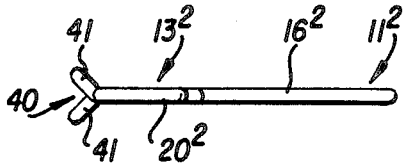
FIG. 7 is an elevational view of the clip shown in FIG. 6.

Clip $10^2$ which is shown in FIGS. 6 to 8 is symmetrical with respect to axis $X^2$. The clip $10^2$ has parts 41 equally bent and sloping to the sides and which are mutually separated from each other, the touching occurring at evasion arm 40. Pressing units $13^2$ are smoothly opened on either side of the back retainer $11^2$ by both base-losing part 41 and evasion arm 40. FIG. 8 shows the condition in which the clip $10^2$ grips the sheets $14^2$. As shown in FIG. 8, the crossing arms $18^2$ do not touch at the crossed part 40. Pressing units $13^2$ press the surface of sheet $24^2$ of the gripped sheets $14^2$ with balance. The sides of the base edge part $17^2$ and outer edge part $19^2$ of both crossing arms $18^2$ are disposed closely along the edge $25^2$. Even if the pressing units $13^2$ are opened to either side of the back retainer $11^2$, the crossing arms do not touch. Therefore, clip $10^2$ does not have imbalance of the gripped part even if the sheets are gripped by either side of the face and the back of the clip or in spite of the overall thickness of the sheets.

When the clip is used for thick sheets, the outer side of the crossing arms are widely separated from the base edge thereof, so that in use, the crossing arms do not touch. Therefore, it is not necessary that the edge of outer side of both base-losing parts 41 come out to the outer side in passing to the base edge part $17^2$. It is desirable to shorten the length of the part which projects to the back part as much as possible, to extend the touching part toward the edge face of the gripped sheets of the back part, and to improve the stability of the clip. Regarding the angle of the slope of the touch evasion arm 40, it is not necessary to have angles which are equal. It is desirable from the point of view of balance, but it is also possible to strongly slope only side. However, in this case, it is possible to avoid touching of the crossed parts.

Figure 10:
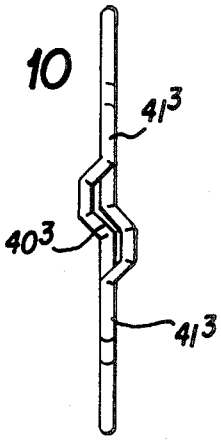
FIG. 10 is an elevational view of the clip shown in FIG. 9.
Figure 9:
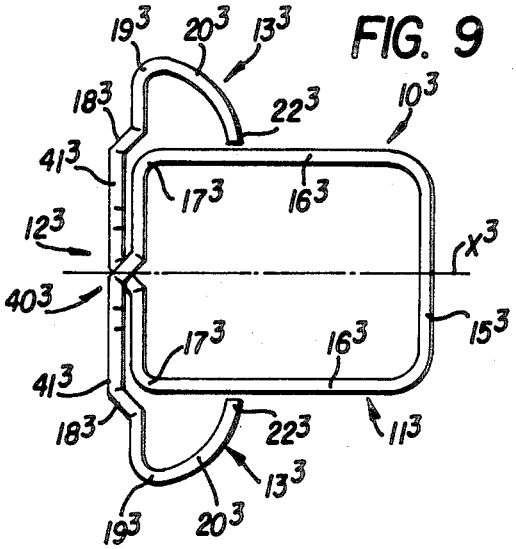
FIG. 9 is a plan view of a clip according to a further alternate embodiment.

FIGS. 9 and 10 show another form. A clip $10^3$ has touch evasion arm $40^3$ bent only at the edge part of the symmetrical axis $X^3$ of both base-losing part $41^3$ to the side which separates mutually against each side. The clip $10^3$ provides good balance at both sides of the back retainer as in the case of clip $10^2$. Moreover, clip $10^3$ has the advantage in that the projecting to the face and back sides of the gripped sheets is more conspicuous. Also, with clip $10^3$, it is not necessary to have mutually equal sloping angles for the touch evasion arm $40^3$. In pressing units $13^3$, the curved part $20^3$ approaches toward part $16^3$ from the outer edge part $19^3$ of crossing arms while sloping, and has an expanded curve to the outer side with a moderate curvature. This form is desirable because the edge parts of the pressing units come to the surface a little and are smooth at the time of using the clip.

The present invention is not limited to a U-shaped form for the back retainer. For example, it is possible to form the back retainer in a V-shape with the rear opened or a form similar to a V-shape. It is also possible to arrange projections 31 (FIG. 1) or a rough face on a suitable part of the back retainer for the purpose of improving its functioning as a clip. Using various designs for the edge part of the pressing units is also possible. For example, this would include projecting such part spherically, sharpening toward the pressing direction, making an uneven rough face, or spreading or patching in high frictional resistant parts.

A clip of the present invention is produced by using one elastic linear wire which is of sufficient size that provides enough pressure to the edge part of the pressing units by the shafts. For instance, the clip may be made from semi-hard steel wire, stainless steel wire, nonferrous-metal wire, plastic wire having high strength or resemble wire. Also, without using wires and bending, it is also possible to use suitable elastic wire which is molded. Changing one part of the above-mentioned forms and replacing with one of the others, or suitably combining them, are also possible according to the present invention.

I claim:

1. A clip comprising a generally planar back unit which is generally symmetrical about a symmetrical axis, said back unit having a pair of shaft portions disposed on opposite sides of said symmetrical axis, said shaft portions each being spaced from said symmetrical axis at a first distance, crossing arms extending from said shaft portions and extending generally transversely of said symmetrical axis, and a pair of pressing units disposed on opposite sides of said symmetrical axis, said pressing units being connected to a respective crossing arm, said pressing units extending on opposite sides of said symmetrical axis to a second distance which is greater than said first distance, each of said pressing units having a terminating end section juxtaposed to a respective intermediate section of said shaft portion, said pressing units being movable relative to said back unit from a relaxed state to an open position such that in said open position a space is provided between said back unit and said pressing units for disposing sheets therebetween, said pressing units being movable to said open position by the torsional twist of said shaft portions, said terminating end sections engaging and contacting said sheets when said pressing units are in said open position such that said sheets are thereby clipped and retained between said pressing units and said back unit.

2. A clip according to claim 1, wherein each of said pressing units has a generally U-shaped configuration having two legs, one of said legs being a continuation of one of said crossing arms, the other of said legs being a continuation of one of said terminating end sections.

3. A clip according to claim 2, wherein each of said terminating end sections has a terminating end, said terminating end overlying a respective shaft portion.

4. A clip according to claim 2, wherein each of said terminating end sections has a terminating end, said terminating end being disposed outwardly of a respective shaft portion.

5. A clip according to claim 1, wherein said back unit together with portions of said crossing arms have a generally rectangular configuration.

6. A clip according to claim 1, wherein said back unit defines a back plane, said terminating end sections being constructed to slope relative to said back plane, said terminating end sections sloping closer to said back plane as the terminating end of said terminating end section is approached.

7. A clip according to claim 1, wherein a first and a second crossing arm are provided, said back unit defining a back plane, said first and second crossing arms each having a central section, an outer end section and an inner end section, said inner end section being connected to a respective back unit, said central sections being juxtaposed to one another such that the axes of said central sections are disposed in a plane parallel to said back plane, said outer end section of said first crossing arm overlying the inner end section of said second crossing arm and the outer end section of said second crossing arm underlying the inner end sections of said first crossing arm.

8. A clip according to claim 1, wherein said back unit defines a back plane, said crossing arms each having a central section, an outer end section and an inner end section, said inner end section being connected to said back unit, the outer end section of a first crossing arm and the inner end section of the second crossing arm overlying one another with the axes thereof being disposed in a plane perpendicular to said back plane, the inner end section of the first crossing arm and the central sections of the second crossing arm being juxtaposed with the axes thereof being disposed in a plane parallel to said back plane.

9. A clip according to claim 8, wherein the axis of the outer end section of said crossing arm is disposed in said plane perpendicular to said back plane.

10. A clip according to claim 1, wherein said back unit defines a back plane, each of said crossing arms having a cross-over section, an intermediate section and an inner end section, said inner end sections being joined to said back unit, said cross-over sections extending obliquely across aid symmetrical axis and overlying one another at said symmetrical axis, the inner end section of a first crossing arm being spaced from the intermediate section of the second crossing arm, the inner end section of the second crossing arm being spaced from the intermediate section of the first crossing arm.

11. A clip according to claim 10, wherein the axes of said intermediate and inner end sections of said first and second crossing arms are disposed in a common plane, said common plane being coincident with said back plane.

12. A clip according to claim 10, wherein each of said crossing arms has an outer end section, said intermediate sections of said first and second crossing arms being joined to said outer end sections by a connector portion, said connector portion being disposed obliquely relative to said symmetrical axis.

13. A clip according to claim 10, wherein each of said pressing units has a generally U-shaped configuration having two legs, one of said legs being a continuation of the associated crossing arm, said one leg having its axis coincident with the axis of the inner end section of the respective crossing arm.

14. A clip according to claim 10, wherein each of said crossover sections has a generally U-shaped configuration as viewed in a plane perpendicular to said back plane.

15. A clip according to claim 1, wherein said terminating end portion has an arcuate configuration.

16. A clip according to claim 1, wherein said terminating end sections extend in a direction perpendicular to said symmetrical axis.

17. A clip according to claim 1, wherein said terminating end sections extend in a direction disposed at an acute angle relative to said symmetrical axis.

18. A clip according to claim 17, wherein said terminating end sections extend closer to said crossing arms as the terminating ends of the terminating end sections are approached.

* * * * *